United States Patent [19]

Daniels et al.

[11] 4,343,133

[45] Aug. 10, 1982

[54] POLYVINYL ACETATE LATEX IMPREGNATED TOWELETTE

[75] Inventors: Wiley E. Daniels, Easton, Pa.; George Davidowich, Dunellen; Gerald D. Miller, Belle Mead, both of N.J.

[73] Assignee: Air Products and Chemicals, Inc., Allentown, Pa.

[21] Appl. No.: 163,240

[22] Filed: Jun. 26, 1980

Related U.S. Application Data

[62] Division of Ser. No. 870,551, Jan. 18, 1978, Pat. No. 4,245,744.

[51] Int. Cl.[3] ..... B65B 5/04

[52] U.S. Cl. ..... 53/431; 53/474

[58] Field of Search ..... 206/812, 205, 210; 428/289, 290, 296; 53/428, 429, 431, 469, 474

[56] References Cited

U.S. PATENT DOCUMENTS

| | | | |
|---|---|---|---|
| 3,135,648 | 6/1964 | Hawkins | 260/29.6 BM X |
| 3,213,051 | 10/1965 | Pierce | 260/29.6 BM |
| 3,355,322 | 11/1967 | Worrall | 428/477.7 X |
| 3,438,808 | 4/1969 | Hawkins et al. | 525/62 X |
| 3,654,928 | 4/1972 | Duchane | 128/290 W |
| 3,881,210 | 5/1975 | Drach et al. | 206/812 X |
| 3,895,474 | 7/1975 | Bauer | 53/431 X |

*Primary Examiner*—John Sipos
*Assistant Examiner*—Charles L. Willis
*Attorney, Agent, or Firm*—Richard A. Dannells, Jr.; E. Eugene Innis

[57] ABSTRACT

Nonwoven fibrous sheets impregnated with latices of polyvinyl acetate or its copolymers containing polyvinyl alcohol, intended for use in pre-moistened condition as skin cleansing tissues, are folded and packaged in closed containers or in individual sealed water impervious envelopes; said packaged sheets being maintained in contact with a dilute aqueous solution of a precipitating or gelling agent for polyvinyl alcohol, such as boric acid. The agent imparts improved wet tensile strength to the sheet during storage and use by the consumer but permits the sheet to be safely disposed of, after use, by flushing in plain water without danger of clogging the plumbing system.

6 Claims, No Drawings

POLYVINYL ACETATE LATEX IMPREGNATED TOWELETTE

This is a division of application Ser. No. 870,551 filed Jan. 18, 1978 now U.S. Pat. No. 4,245,744, issued Jan. 20, 1981.

BACKGROUND OF THE INVENTION

1. Field of the Invention

This invention relates generally to disposable wet-packaged skin cleansing fabrics or cloths formed of paper or other non-woven fibrous webs of the kinds generally known in the art as towelettes, wet-wipes, fem-wipes and the like. It is particularly concerned with the provision of such fabrics which will retain suitable wet tensile strength during storage and use but which can be readily disposed of by flushing in water without danger of clogging the plumbing system.

2. Prior Art

Wet-packaged skin cleansing and refreshing tissues are well known commercially, generally referred to as towelettes, wet-wipes, fem-wipes, and the like. Typical examples of such products are described in U.S. Pat. Nos. 3,057,467; 3,563,371; and 3,398,826. These may comprise an absorbent sheet made of paper, prepared or treated to impart wet strength thereto, having the dimensions of the usual wash cloth and packaged wet in folded condition individually in impervious envelopes or in multiples in closed containers. The liquid employed in pre-moistening the sheet is generally an aqueous alcoholic solution which may further contain a surface-active detergent and a humectant and in some instances also a scenting agent. Instead of individual packaging of such moist sheets, these are often marketed in recloseable containers having any desired convenient numbers of such folded sheets. A typical example of such products particularly designed for use in feminine hygiene, popularly known as "fem-wipes", is disclosed in U.S. Pat. No. 2,999,265.

Certain of the earlier known products suffer from the drawbacks of excessive loss of wet strength on account of being kept moist for even relatively short periods of storage, thereby interfering with their intended use by the consumer. Others of these known products which retain adequate wet strength, cannot be readily disposed of by flushing in water in conventional toilet bowls, since the binders employed in imparting wet strength do not disintegrate sufficiently and thus often cause clogging of the plumbing. In some instances it has been advocated that acidic or alkaline materials respectively be added to the water employed in flushing the used cloths to assist in disintegrating the binder therein, these being selected in accordance with the nature of the resinous binder employed.

Polyvinyl alcohols (PVOH) are well known in commerce for use in textile and paper sizing and coating, as adhesives, binding agents, dispersing/stabilizing agents for emulsions, and the like. These alcohols are generally manufactured by polymerizing vinyl acetate and hydrolyzing the polymer to an alcohol. The marketed grades of polyvinyl alcohol vary in degree of polymerization and degree of hydrolysis. As used herein, "fully hydrolyzed" products are those which have been hydrolyzed to about 95% or higher and up to about 99% by weight. Polyvinyl alcohols having a degree of hydrolysis above 99% are designated as "super hydrolyzed". Films produced from polyvinyl alcohol grades having a degree of hydrolysis above about 95% are resistant to attack by cold water; the extent of water resistance increasing directly with increase in the degree of hydrolysis. Polyvinyl alcohols of lower degree of hydrolysis than the so-called fully hydrolyzed products, such as the "partially hydrolyzed" grades (80–95% by weight hydrolyzed) are almost completely soluble in water at room temperature, while the fully hydrolyzed products have more limited cold water solubility.

Changes in the degree of polymerization affect solution viscosity; i.e. the viscosity of "fully hydrolyzed" and "partially hydrolyzed" products of low viscosity (in 4% aqueous solution at 20° C.) are about 10 cps, medium viscosity are in the range of about the 20–35 cps, and high viscosity are in the range of about 40 cps and above. The viscosity of the aqueous solution of the polyvinyl alcohol is thus an indication of the degree of polymerization.

Surface sizing of paper with aqueous mixtures of polyvinyl alcohol and boric acid is disclosed in U.S. Pat. No. 3,438,808. The boric acid in admixture in the amount of 15% or more of the polyvinyl alcohol and applied in heated condition to the wet, inhibits the extent of penetration of migration of the sizing composition into the paper.

Vinyl acetate copolymer emulsions containing polyvinyl alcohol as a protective colloid are known in the art for use as adhesives, thickeners, coating compositions and the like. Such compositions comprising vinyl acetate-ethylene copolymer emulsions are disclosed, for example, in U.S. Pat. Nos. 3,355,322; 3,708,388; and 3,906,135.

According to U.S. Pat. No. 3,213,051, quick-setting laminating adhesives are prepared by incorporation of boric acid in a polyvinyl acetate emulsion containing polyvinyl alcohol as a protective colloid. To prevent excessive thickening of the emulsion in storage, a viscosity stabilizer and gelation retarding agent is incorporated therein, such as a thiocyanate or urea.

It is also known to employ certain resins and other polymeric materials as binders or coatings on nonwoven fabrics used as toilet-flushable products such as wrappers or outside coverings for diapers and sanitary napkins, surgical dressings and the like, wherein such fabrics need have during their intended use sufficient tensile strength not to disintegrate while in contact with body fluid discharges. Among binders suggested for use in such fabrics are aqueous dispersions of mixtures of acrylic resins and polyvinyl alcohol, as disclosed, for example, in U.S. Pat. No. 3,561,447. In U.S. Pat. No. 3,480,016 it is proposed to employ as a binder for such nonwoven fabrics used for absorbing body discharge, a polymer resin which is (1) stable in neutral or acidic media but which dissolves or degrades in alkaline media or (2) a polymer resin which is stable or insoluble in neutral or alkaline media but soluble or degradable in acidic media; or (3) polymers degraded by oxidizing agents. To dispose of such fabrics after use, the suitable degrading agent is added to the flush water. Among the examples of alkaline degrading agents disclosed are ammonium borate and alkali metal borates. Among the acidic degrading agents named are boric acid and inorganic acid salts.

The use of cold water soluble polyvinyl alcohol in the absence of other resins or polymers as such bonding agent for disposable nonwoven fabrics, is disclosed in U.S. Pat. Nos. 3,654,928; 3,689,314; 3,692,725; and 3,808,165. To prevent premature structural weakening or disintegration of the fabric as a result of dissolution of the polyvinyl alcohol binder in the presence of body discharge fluids the polyvinyl alcohol film is oversprayed with a gelling or insolubilizing agent such as borax or a mixture reacting to form alkali metal borate in situ. The borax or alkaline borate is stated to react with the polyvinyl alcohol and cross-link at least the exposed surface areas to a sufficient degree to render the reacted binder, when dried, somewhat water resistant. When the treated fabric is exposed to a large excess of water, the borax is said to be leached out and thus enough of the cross-linkages in the polymer are destroyed to reduce water resistance to a non-effective level.

SUMMARY OF THE INVENTION

The foregoing drawbacks of the prior art wet-packaged tissues are overcome by the products of the present invention wherein such wet packaged cloths are made of nonwoven fibers coated or impregnated with a binder comprising a dried emulsion of a vinyl acetate-ethylene copolymer containing polyvinyl alcohol as a protective colloid. The cloths are packaged in contact with an aqueous cleansing liquid containing a compound serving to temporarily insolubilize the binder, such as boric acid, thereby preserving adequate wet strength of the cloth during packaged wet storage and use of the cloth by the consumer yet permitting safe disposition thereof, after such use, by flushing in plain water without danger of clogging conventional plumbing equipment.

Among the objects of the present invention are to provide a pre-moistened towelette or skin cleansing wiper having sufficient wet tensile strength throughout its shelf life and during intended use by the consumer, and which after use may be discarded safely by flushing in plain water without danger of clogging the plumbing system.

To attain such objectives nonwoven fibrous webs are treated with an aqueous emulsion or latex of polyvinyl acetate (PVAc) or vinyl acetate/ethylene copolymers (PVAc/E) containing polyvinyl alcohol as a protective colloid, and the webs dried to form a surface coating. Sheets of such coated web of suitable desired size for use as disposable wet skin cleansing tissues, are folded and packaged while wet in contact with an aqueous solution of boric acid in a concentration up to the limits of its solubility or with an aqueous solution of a soluble salt having an acid to neutral pH on hydrolysis and in a concentration of up to about 20 percent by weight.

DETAILED DESCRIPTION

The initial treatment to coat or impregnate the nonwoven fabric, such as absorbent paper, with the emulsion of PVAc or PVAc/E may be carried out by immersing webs or running lengths of the fabric in the emulsion or by applying the emulsion thereon to the surfaces of the fabric by spraying, by padding or by other type of application. Following drying, the treated web may then be cut to the desired size sheets for the intended use. If desired, of course, individual sheets pre-cut to desired size may be treated with the emulsion.

The emulsion used as the impregnant comprises 100 to 40% by weight vinyl acetate and 0 to 60% by weight ethylene. The emulsion is prepared by emulsion polymerization of vinyl acetate alone or with ethylene at pressures substantially greater than atmospheric in the presence of 1 to 10 parts by weight polyvinyl alcohol, preferably 2 to 6 parts by weight, per 100 parts of emulsion as a protective colloid to stabilize the emulsion. The polyvinyl alcohol or mixture of such polyvinyl alcohols is of the cold water soluble or at least cold water dispersible type being less than 99% hydrolyzed, preferably 80–90% hydrolyzed polyvinyl acetate, and having a low to medium viscosity (4 to 30 cps.). The emulsion containing the protective colloid should contain 50 to 65% by weight total solids and have a viscosity in the range of 1,000–2,000 cps. The amount of emulsion applied to the nonwoven fabric is such as to provide 2 to 50% by weight dry add-on, preferably 5 to 20% by weight.

The nonwoven fabric web may be of any of the types heretofore employed for disposable towelettes or wipes such as those comprising carded or randomly oriented or cross-laid fibers. The fibers may be of natural or regenerated cellulose, other synthetic or proteinaceous fibers of biodegradable materials, or mixtures of these.

The finished towelettes or wipes of desired dimensions may be individually packaged, preferably in folded condition, in moisture proof envelopes or in containers holding any desired number of such folded sheets. For individual packaging it will be convenient to wet the folded sheet with the boric acid solution prior to inserting the same into the envelope, or the liquid may be injected into the open envelope which is thereafter sealed. If a number of the wet sheets are to be packaged in a single container which can be closed and reopened for removal of individual towelettes or wipes as needed, the folded sheets may either be pre-moistened with the boric acid solution or such solution may be poured over the stacked sheets in the container under conditions assuring appropriate wetting of each of the individual sheets therein. Preferably, the concentration of the boric acid solution is at least 1% by weight up to the limits of its solubility in water. More preferably, the boric acid concentration is in the range of about 3 to 5% by weight, with 5% being the solubility limit of boric acid at room temperature.

Various forms of impermeable envelopes for containing wet-packaged materials such as towelettes, wiping and polishing cloths and the like are well-known in the art. Any of these may be employed in packaging the wetted towelettes of the present invention. The envelopes for individual packaging may be formed of any material impervious to the liquid contents and not adversely affected thereby. Thus, the envelopes may be made of plastic materials or of cellulosic materials lined or coated with plastic or other waterproof compositions. Preferably, the envelope should be of a type that can be conveniently opened by tearing to remove the packaged wet towelette.

The following examples are illustrative of various features of articles of this invention and their method of preparation. Unless otherwise indicated in these examples, percent refers to weight percent.

EXAMPLE 1

A 60% vinyl acetate-40% ethylene copolymer emulsion containing 4% PVOH (75% VINOL 205 and 25% VINOL 523) by weight of the copolymer, and containing a total of 52% solids was cast to form a film of 15 mil wet thickness and air dried. While the film retained its definition when immersed in water, it exhibited practically no wet tensile strength as evidenced by the fact that it could not suspend its own weight.

VINOL 205 is a partially hydrolyzed PVOH grade (87–89% hydrolyzed) of low viscosity (4–6 cps) and VINOL 523 is also a partially hydrolyzed PVOH grade (87–89% hydrolyzed) of medium viscosity (about 23 cps).

When immersed in a 5% boric acid solution, the film exhibited surprisingly good wet tensile strength and was highly elastic. However, this film removed from the boric acid solution was redispersed in plain water in less than two minutes.

The treated film in contact with boric acid solution retained wet tensile strength for more than 30 days at 130° F. (54.4° C.). At 160° F. (71.1° C.) the film retained wet tensile strength for 3 days indicating excellent film stability and shelf life at the elevated temperatures that may be experienced under storage conditions.

EXAMPLE 2

The same emulsion as employed in Example 1 was diluted and applied to a paper substrate.

The emulsion was diluted with water to a 25% total solids content and applied to both sides of a 42 pound/3300 square foot (19 kg/307 mg/square meters) paper substrate, and the treated paper dried at 120° C. in a forced air oven. The pick-up was 3.5 pounds (1.59 kg) dry emulsion.

A sample of the dried emulsion treated paper, as determined by conventional Instron test, showed a wet tensile, after immersion in water, of 1.08 pounds (0.49 kg) as compared to the untreated stock which showed a wet tensile of 0.72 pounds (0.33 kg).

A duplicate sample of the dried emulsion treated paper immersed in 5% boric acid solution for 2 minutes when tested by Instron exhibited a tensile of 1.41 pounds (0.64 kg). When reimmersed in plain water for 2 minutes, the paper returned to about its initial wet strength, 1.09 pounds (0.49 kg).

Another duplicate sample of the dried emulsion treated paper was immersed in 5% boric acid solution for 30 minutes maintained about the same tensile as that previously shown for the boric acid treatment while the water value on reimmersion decreased to 0.91 pounds (0.41 kg).

It should be noted that the paper in the foregoing example had a relatively low dried emulsion add-on. At higher add-on levels or lower basis weight substrate greater relative increase in tensile may be realized.

EXAMPLE 3

While in the foregoing examples, boric acid is employed as the agent for increasing the wet strength of the nonwoven fiber sheet during storage and use, certain water soluble salts known to react with polyvinyl alcohol to effect precipitation or gelling thereof, may be employed. These are less preferred than boric acid, however, since larger concentrations of these are required for the desired purpose.

A list of such soluble salts for gelling or precipitating polyvinyl alcohol is reproduced in the table below. Table 1 shows the minimum concentration causing precipitation of the salts and boric acid dissolved in a 5% solution of polyvinyl alcohol (98–99% hydrolyzed, degree of polymerization 1700–1800).

TABLE 1*

| Compounds | Minimum Concentration for salting out (g/l) |
|---|---|
| $(NH_4)_2SO_4$ | 66 |
| $Na_2SO_4$ | 50 |
| $K_2SO_4$ | 61 |
| $FeSO_4$ | 105 |
| $MgSO_4$ | 60 |
| $Al_2(SO_4)_3$ | 57 |
| $KAl(SO_4)_2$ | 58 |
| Potassium citrate | 38 |
| $H_3BO_3$ | 16.5 |

*Data on the soluble salts of Table 1 were taken from Finch C.A., POLYVINYL ALCOHOL, 1973; John Wiley & Sons, Ltd. Table 23 at page 40.

Table 1 indicates, for example, that sodium sulfate will effect precipitation of a 5% solution of fully hydrolyzed polyvinyl alcohol at a salt concentration of 0.7 normality (50 grams/liter); boric acid will do so at 0.8 normality or 16.5 grams/liter.

EXAMPLE 4

Cast films of the same emulsion as employed in Example 1 (1"×6"=2.5×15.24 cm) were separately tested to determine solubility respectively in boric acid solutions and in sodium sulfate solutions at different concentrations. The results are reported in Table 2.

TABLE 2

| Solute g/100 cc water | Film description |
|---|---|
| Sodium sulfate | |
| 0 | Weak film. |
| 5 | Some film strength development. |
| 20 | Stronger film. |
| Boric acid | |
| 0 | Weak film. |
| 1 | Some film strength development. |
| 3 | Stronger film. |
| 5 | Optimum film strength. |

From the foregoing results, it appears that while the soluble salts, such as sodium sulfate, can be employed to retard solubilization of polyvinyl acetate films, somewhat greater concentrations, i.e. about 3 to about 20%, are required that when using boric acid.

As projected from the data set forth in Tables 1 and 2, potassium citrate appears to be even more efficient than sodium sulfate in the articles of this invention.

Specific modes of preparing the packaged towelettes of the present invention have been described above. It is contemplated that other ingredients commonly found in towelettes of the prior art can be included in the package of this invention without departing from its spirit. Such ingredients include a humectant such as propylene glycol, skin protecting agents such as allantoin or resorcinol and a variety of perfumes and other scenting agents. All such variations that fall within the scope of the appended claims are intended to be embraced thereby.

What is claimed is:

1. A method of preparing a packaged towelette having enhanced wet strength while maintained in wet condition in a sealed container package and while during use until flushed in water, comprising:

(a) forming an emulsion binder of a vinyl acetate-ethylene copolymer containing polyvinyl alcohol as a protective colloid in a web of nonwoven fibers to form an emulsion impregnated towelette;

(b) packaging said impregnated towelette in an impervious, closed container; and (c) maintaining said emulsion binder in a gel-like form in a wet condition in said container by contact with a non-alkaline aqueous solution of boric acid having a concentration of at least 3% by weight up to its limit of solubility, thereby temporarily insolublizing said binder until flushed in water.

2. A method of preparing a packaged towelette having enhanced wet strength while maintained in wet condition in a sealed container package and while during use until flushed in water comprising:

(a) forming an emulsion binder of a vinyl acetate-ethylene copolymer containing a water soluble polyvinyl alcohol as a protective colloid in a web of nonwoven fibers to form an emulsion impregnated towelette;

(b) packaging said impregnated towelette in an impervious, closed container; and (c) maintaining said binder in a gel-like form in a wet condition in said container by contact with a non-alkaline aqueous solution of a water soluble salt selected from the group consisting of sodium sulfate and potassium citrate, wherein said binder is temporarily insolubilized until flushed in water.

3. A method according to claim 2 wherein said solution of soluble salt consists essentially of sodium sulfate at a concentration of about 3 to about 20% by weight.

4. The method as defined in claim 1 or claim 3 wherein said emulsion contains from 100 to 40% by weight vinyl acetate and 0 to 60% by weight ethylene and 1 to 10 parts by weight polyvinyl alcohol per 100 parts of said emulsion.

5. The method as defined in claim 4 wherein said emulsion contains 40 to 65% solids by weight.

6. The method as defined in claim 4 wherein said emulsion is applied to said web under conditions to effect 5–50% dry add-on by weight of the web.

* * * * *